US005326108A

United States Patent [19]

Faith

[11] Patent Number: 5,326,108

[45] Date of Patent: Jul. 5, 1994

[54] COIN GAME

[76] Inventor: William B. Faith, 6530 Lakeridge Rd., Los Angeles, Calif. 90068

[21] Appl. No.: 914,194

[22] Filed: Jul. 9, 1992

[51] Int. Cl.[5] ..... A63F 9/02

[52] U.S. Cl. ..... 273/355; 124/29

[58] Field of Search ..... 273/355, 356, 357; 124/27, 29, 16

[56] References Cited

U.S. PATENT DOCUMENTS

| | | | |
|---|---|---|---|
| D. 141,095 | 5/1945 | Meyer | D34/5 |
| 1,415,326 | 5/1922 | Fey | 124/29 |
| 2,370,050 | 2/1945 | La Rizza | 273/355 |
| 2,783,754 | 3/1957 | Heiss | 273/357 X |
| 4,123,059 | 10/1978 | Guibas | 273/356 |
| 4,240,536 | 12/1980 | Noell, Jr. | 273/355 X |
| 4,496,160 | 1/1985 | Wichinsky et al. | 273/369 |
| 4,744,566 | 5/1988 | Malavazos et al. | 273/357 |
| 4,759,551 | 7/1988 | Crompton | 273/355 |
| 4,844,464 | 7/1989 | Berge | 273/355 X |

*Primary Examiner*—William H. Grieb
*Attorney, Agent, or Firm*—Lyon & Lyon

[57] ABSTRACT

A game unit having a skill game coined with a prize dispenser. A coin toss gun shoots or tosses coins at targets in the skill game. A wheel unit has a flat top surface. A wiper wipes coins landing on the top surface in geometric paths which may lead to target holes spaced about the circumference of the wheel unit. The coin toss gun has a pull back lever arm for presetting the height of the coin toss.

13 Claims, 17 Drawing Sheets

COIN GAME

BACKGROUND OF THE INVENTION

Various arcade-style games have been known and used in the past. These types of games generally dispense tickets or tokens to a winning player. The player redeems the tickets for a prize at a redemption center at another location within the arcade. Winning tickets or tokens are ordinarily dispensed in proportion to the player's game score or how well the player did. At the redemption center, prizes and merchandise are displayed. By trading in tickets or tokens, the winning player can receive a prize from the operator of the redemption center.

The redemption center requires a substantial amount of space. An attendant is also necessary at the redemption center to count tickets for tokens tendered by winning players in exchange for prizes. Accordingly, redemption centers have not been practical or cost effective at locations having only few machines and players.

As far as is known, all redemption centers have in the past also operated on the principal that arcade games and other skill games are played for fun and amusement, with tickets or tokens dispensed to winners, redeemable for a prize, but not for any specific prize. Accordingly, while playing an arcade game, the player is not attracted or motivated to win any specific prize.

SUMMARY OF THE INVENTION

The present invention is directed to a game unit having a skill game and an automated redemption center linked to the skill game. To this end, a skill game and redemption center are housed in a cabinet. A game controller counts the player's score, indicates prizes available to the player for the score achieved, allows the player to redeem points for prizes during or after the game, and adjusts the player's score for any prizes taken by the player.

Accordingly, it is an object of the present invention to provide an improved game unit.

BRIEF DESCRIPTION OF THE DRAWINGS

Other objects and features of the present invention will become apparent from the following detailed description taken in connection with the accompanying drawings. It is to be understood, however, that the drawings are designed for the purpose of illustration only and are not intended as a definition of the limits of the invention.

In the drawings, wherein similar reference characters denote similar elements throughout the several views.

DETAILED DESCRIPTION OF THE PREFERRED EMBODIMENT

Figure 1:
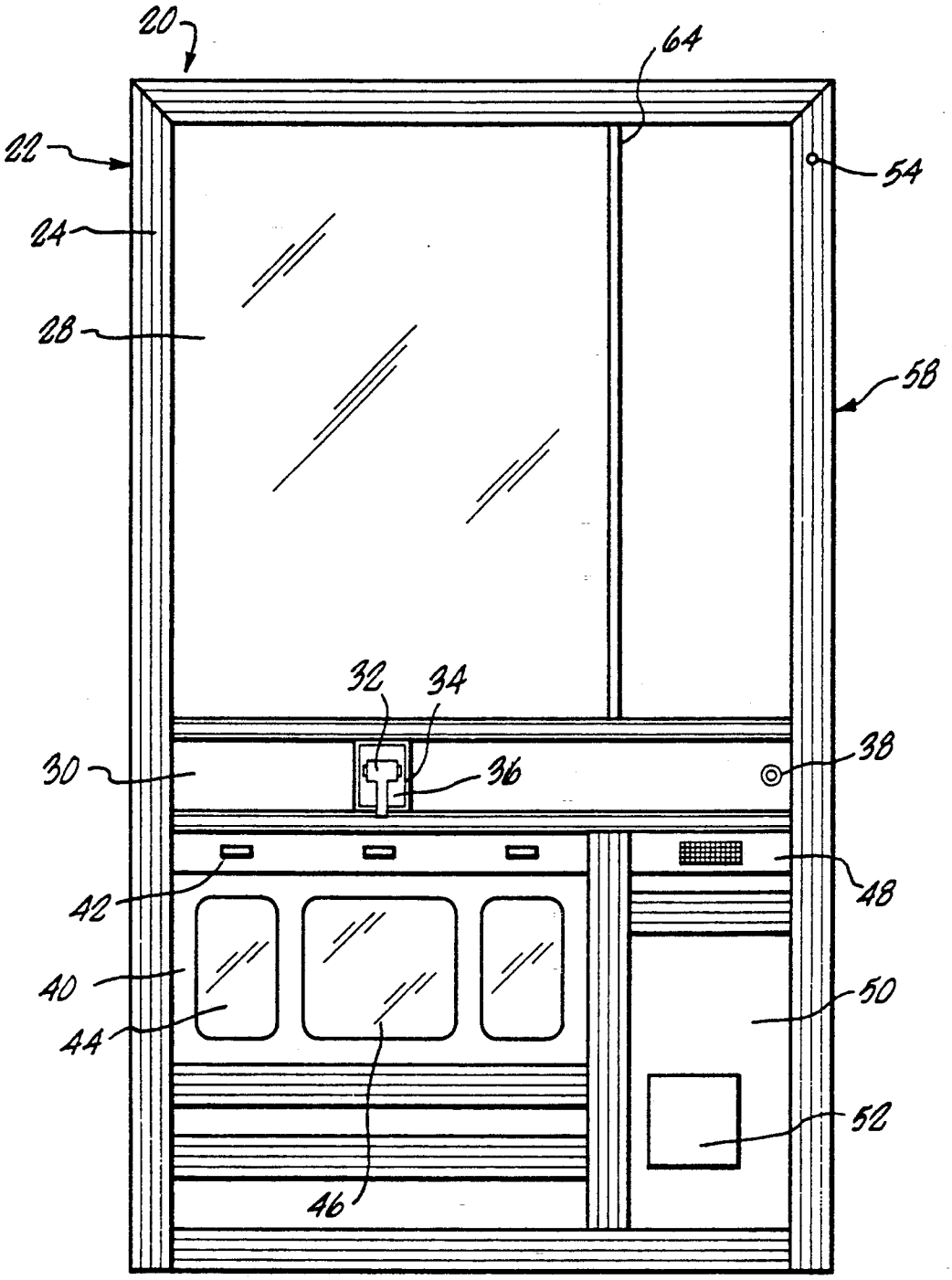
FIG. 1 is a front elevation view showing the front door of the present game unit.

Referring now in detail to the drawings, as shown in FIG. 1, the present game unit 20 includes a cabinet 22 having extruded aluminum edge frames 24. On the front 26 of the game unit shown, a clear panel 28 preferably of tempered glass, extends from approximately the midpoint to adjacent the top of the cabinet 22. Below the clear panel 28 is a gun panel 30. A gun plate 34 on the gun panel 30 has a dual access swivel mount 36 extending through the gun plate 34. A coin toss gun 32 is mounted in the dual access swivel mount 36. A cabinet lock 38 is provided at one side of the gun panel 30.

A bulk dispensing unit 40 is positioned within the cabinet 22 below the gun panel 30. The bulk dispensing unit 40 holds bulk prizes, e.g., gumballs, jawbreakers, etc. Bulk prize display windows 44 allow the game player to view the bulk prizes. Bulk select buttons 42 at the top of the bulk dispensing unit 40 are pressed to select a bulk prize which is released into a tray 46 from which bulk prizes can be picked up by the player.

The extrusion edges 24, clear panel 28, gun panel 30 and bulk dispensing unit are part of the front door 58 of the cabinet 22. The door 58 is hinged to the cabinet 22 and can be unlocked and swung open. A key pad 48 and a retrieval door 52 are also provided on the door 58. Electrical cables running from the bulk dispensing unit 40, select buttons 42 and key pad 48 extend from the door 58 back into the cabinet 22 and connect to a game controller 240.

Figure 2:
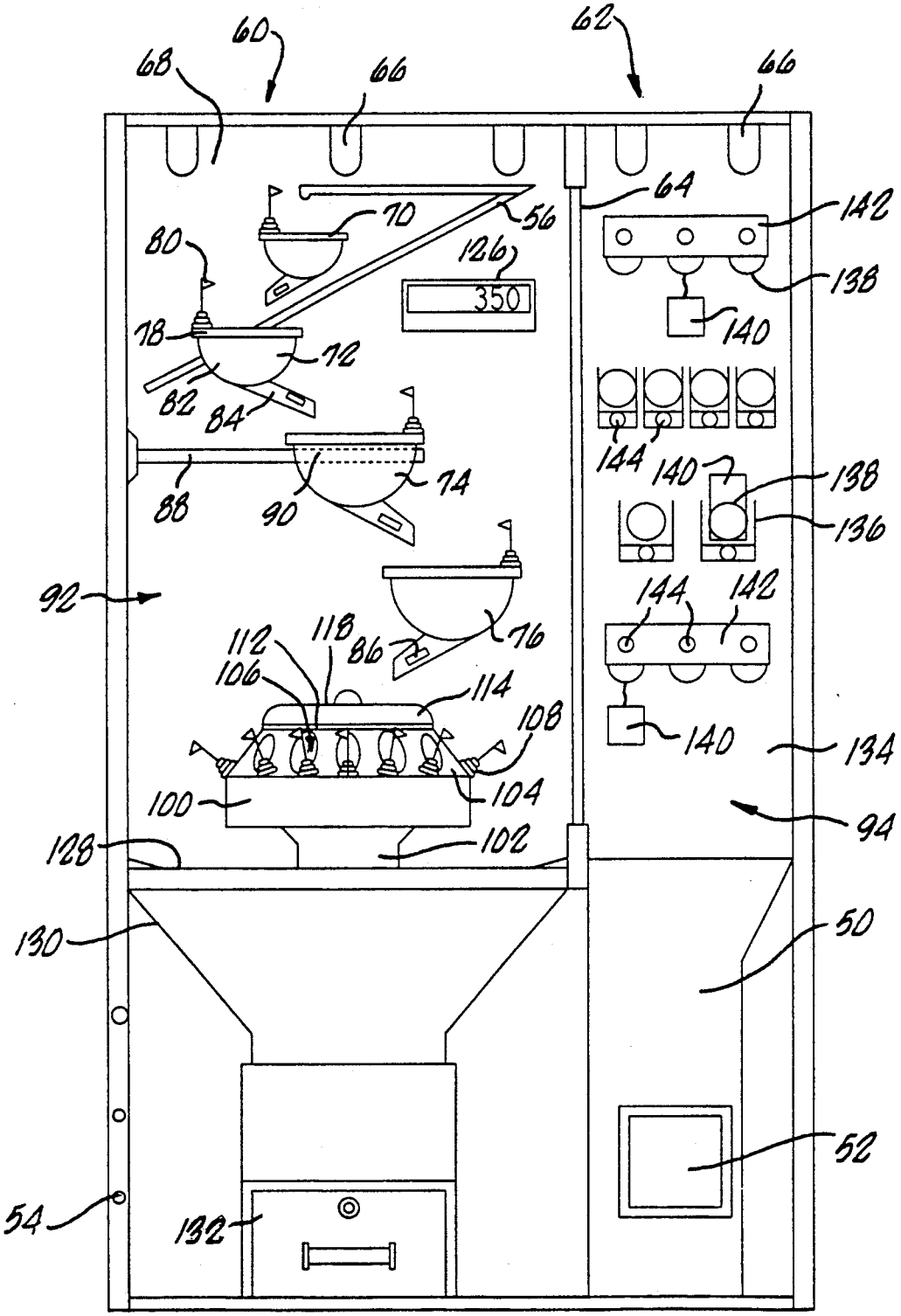
FIG. 2 is a front elevation view of the present game unit with the front door swung open or removed.

FIG. 2 illustrates the game unit 20 without the door 58 shown. As shown in FIG. 2, the cabinet 22 includes a skill game 60 on one side and a prize dispenser 62 on the other side of the cabinet. A divider 64, preferably made of tempered glass, separates the skill game cabinet space 92 from the prize dispenser cabinet space 94. Overhead cabinet lights 66 are provided over the skill game 60 and prize dispenser 62. A back cover panel 68, preferably a reflective grid, is provided behind the skill game 60 within the cabinet 22. Neon lights 56 in artistic or geometric shapes are provided within the cabinet 22 behind the skill game 60, and are preferably also located within the door 58.

The skill game 60 includes one or more bowels which serve as targets for scoring game points. In the embodiment shown, a first bowel 70 is positioned adjacent the top of the cabinet 22, with a second bowel 72, a third bowel 74 and a fourth bowel 76 positioned consecutively below the first bowel 70. The bowels increase progressively in size or diameter from the first bowel 70 down through the fourth bowel 76. Each bowel has a points flag 80 mounted on a bowel rim 78. The points flag 80 indicates the number of points awarded for shooting or tossing a coin into that bowel. A bowel support 88 is attached to a pivot ring 90 on each of the bowels. The supports 88 may be attached to the bottom, sides or top of the cabinet 22, to support each bowel. A coin chute 84 protrudes at an angle from the bottom of each bowel. The coin chute preferably has a flattened rectangular cross section to capture the coin, stand it on edge, direct it through a narrow slot and better control movement of the coin. A coin detector 86 is provided in each chute 84 to detect passage of a coin. The pivot ring 90 allows each bowel to be turned to any specific angular orientation of the chute 84. Coin slides or deflectors can be attached to the chutes. In the embodiment shown in FIG. 2, the bowels are arranged so that a coin tossed into any bowel will be guided into all subsequent lower bowels, thereby consecutively adding to game points earned for that coin. Bowel size preferably range from 1 to 16 inch diameter.

Figure 3:
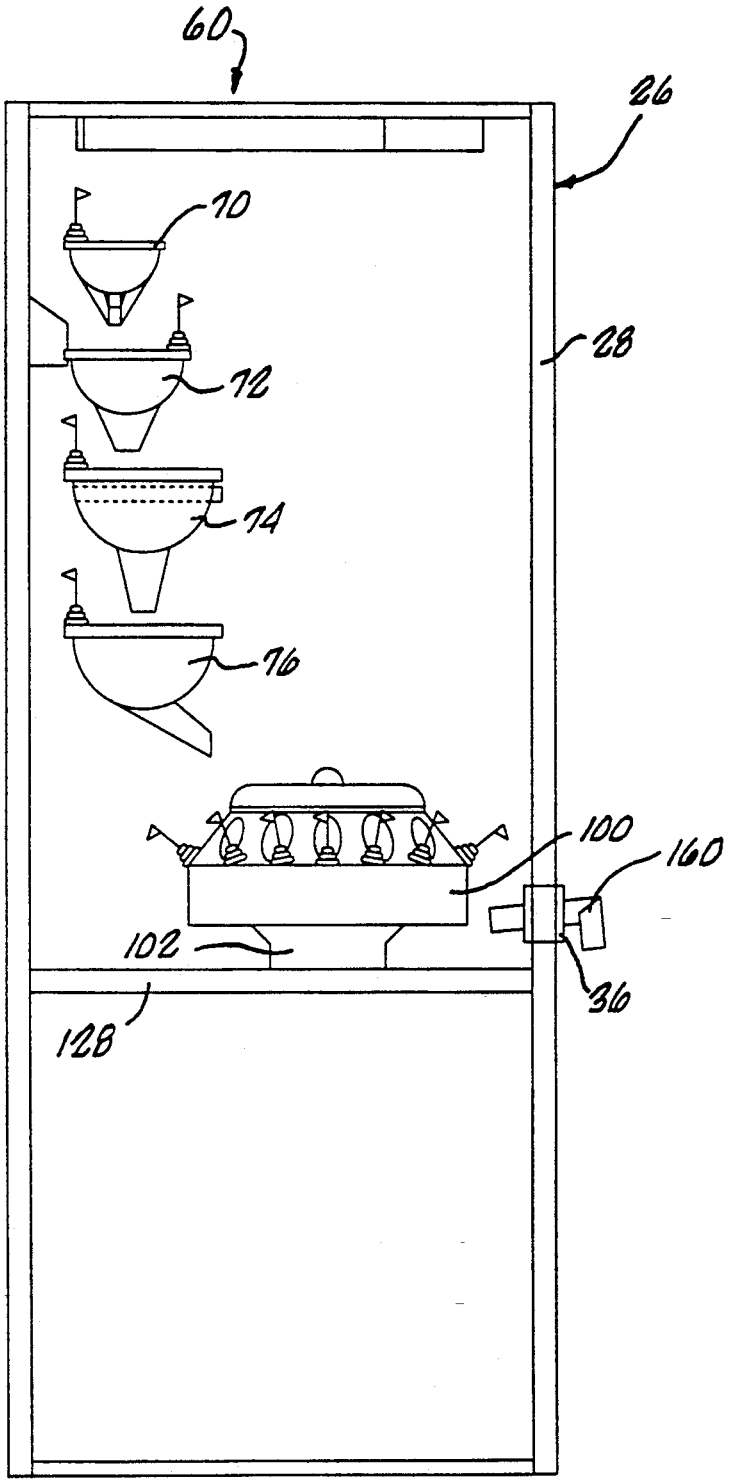
FIG. 3 is a side elevation view of the present game unit.
Figure 4:
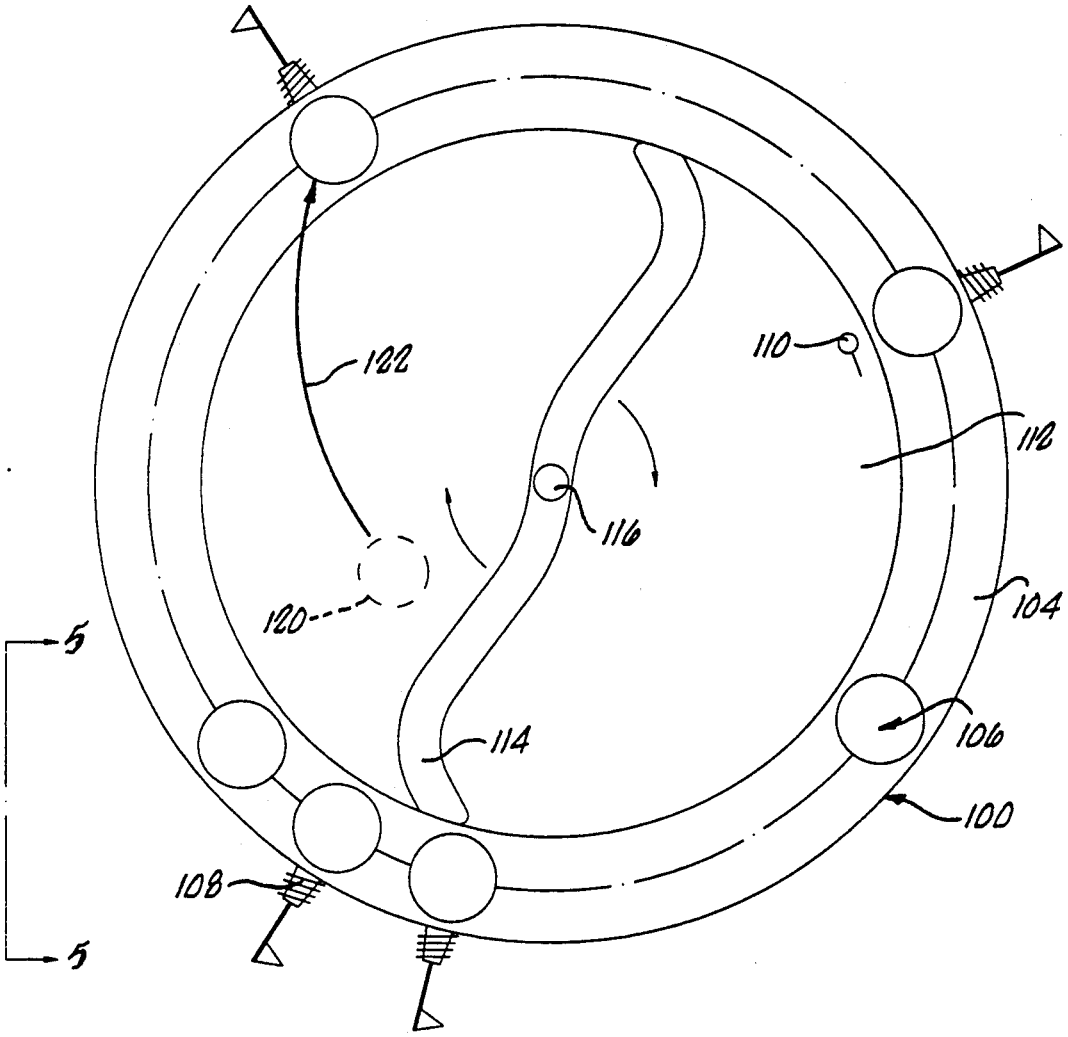
FIG. 4 is a plan view of the wheel unit shown in FIGS. 2 and 3.
Figure 5:
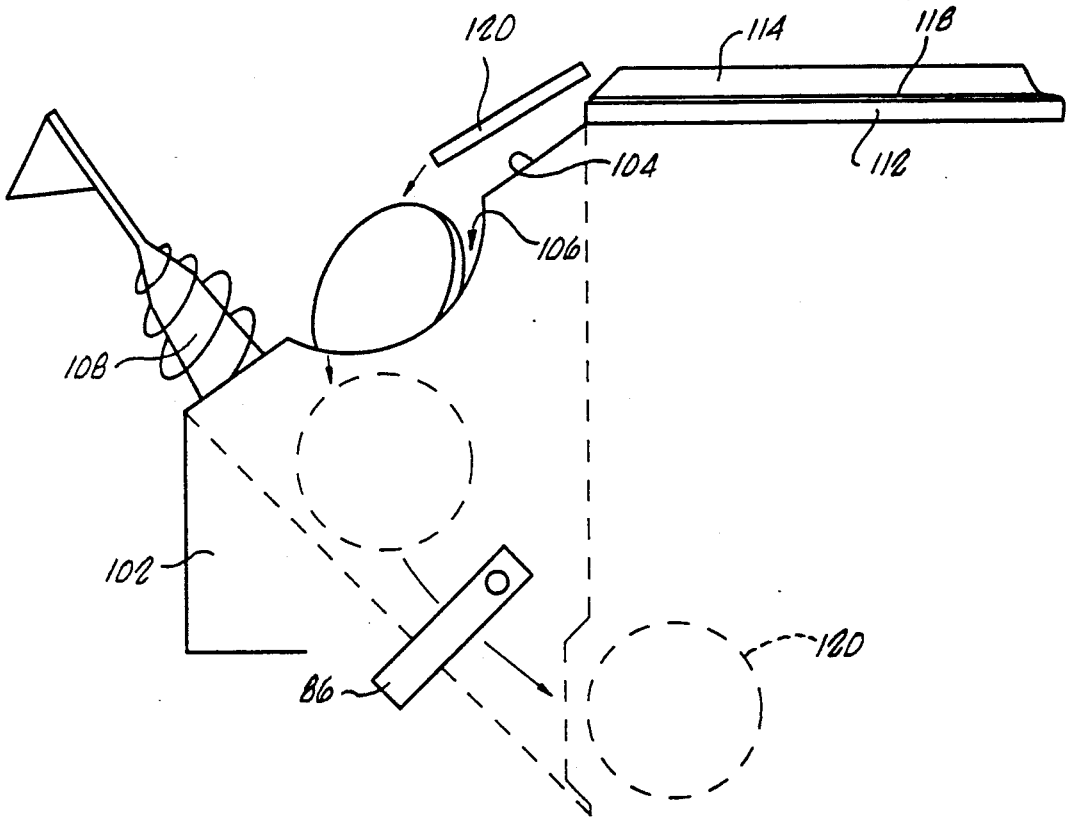
FIG. 5 is a side elevation view fragment taken along line 5—5 of FIG. 4.
Figure 15:
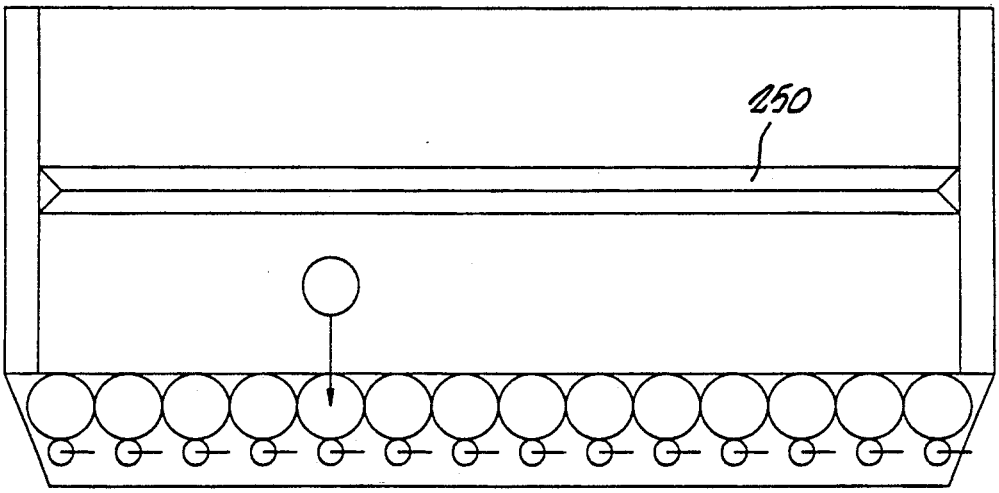
FIG. 15 is a top view of an alternative design having a straight wiper.
Figure 16:
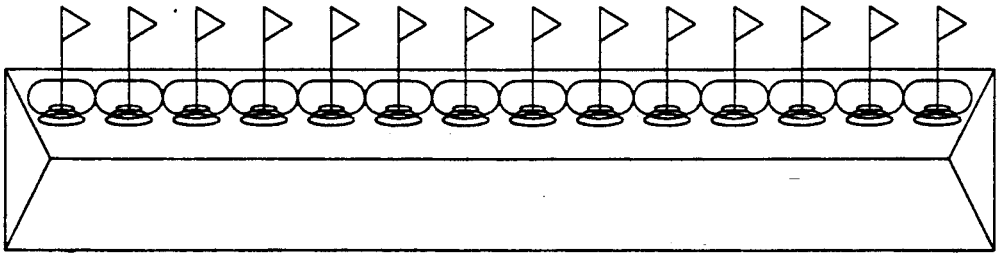
FIG. 16 is a front view thereof.

As shown in FIGS. 2-5, a wheel unit 100 is positioned within the cabinet 22 below the lower most bowel 76. The wheel unit 100 has a fixed base 102 and an angled or tapered target hole surface 104. Target holes 106 are equally spaced around the diameter of the target hole surface 104. Outer posts 108 and inner posts 110 may be provided radially aligned with the target holes, as best shown in FIG. 4. The posts, if used, can be positioned to guide a coin into the target holes. The top surface of the wheel unit 100 is flat and covered with a felt pad 118. A wiper 114 is mounted on a wiper shaft 116 which is slowly turned or alternated by a motor within the base 102. As shown in FIG. 5, a coin detector 86 is associated with each target hole 106 in the wheel unit 100. Alternatively a straight alternating wiper 250 design, as shown in FIGS. 15 and 16 can be used.

Below the wheel unit 100 is a coin grate 128 having openings large enough to allow coins to pass from the skill game cabinet space 92 through the grate 128 and into a slide 130. A coin box 132 is positioned adjacent to the bottom of the skill game cabinet space 92 and is connected to the slide 130 to collect and store coins which fall down from the skill game cabinet space 92.

A point display 126 supported within the skill game cabinet space 92 displays the player's points. The display 126 is linked to the game controller 240 in the cabinet 22 through a wiring harness. The display 126 may optionally be used to convey messages to the player.

Figure 6:
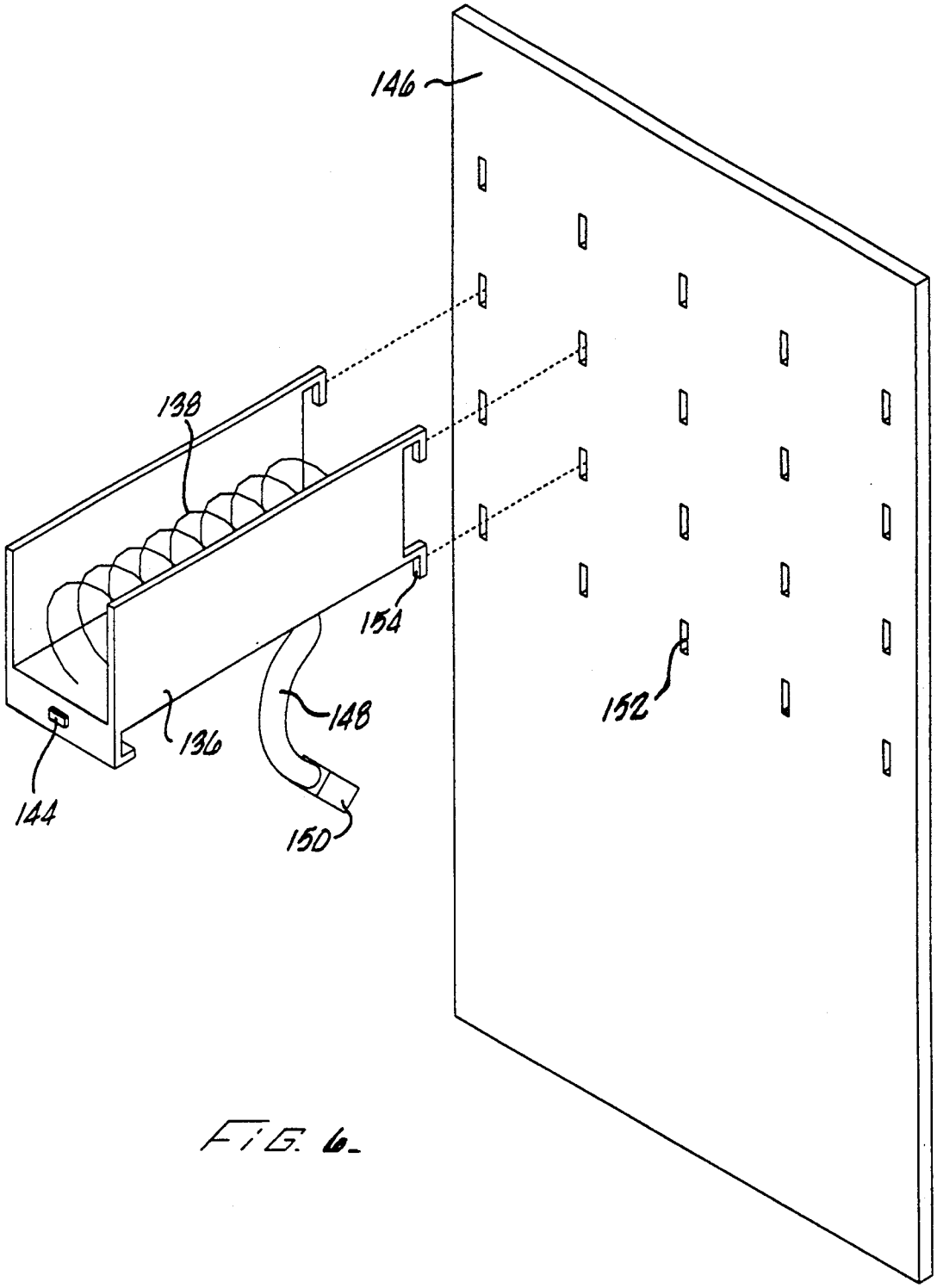
FIG. 6 is an exploded perspective view of the dispenser back panel and a dispenser tray.

Referring to FIGS. 2 and 6, on the side of the partition 64 opposite to the skill game cabinet space 92 is a prize dispenser cabinet space 134, also within the cabinet 22. Alternatively, a separate dispenser cabinet can be joined to a game cabinet. Dispenser trays 136 are positioned within the dispenser cabinet space. Prizes are carried in the dispenser trays 136. A spiral pusher 138 holds and dispenses prizes 140, when actuated by a motor at the rear of the spiral pusher 138. Hanging prize dispensers 142 operate in a similar manner and hold and dispense hanging prizes. A prize light 144 at the front of each dispenser tray 136 and hanging prize dispenser 142 illuminates when sufficient points have been accumulated to award the prize held by that dispenser tray or hanging prize dispenser.

As shown in FIG. 6, a back panel 146 is attached to the cabinet 22 behind the dispenser trays 136 and hanging prize dispensers 142. Hooks 154 on the dispenser trays 136 and hanging prize dispensers 142 engage slots 152 in the back panel 146. A wiring harness 148 leading to the prize light 144 and dispenser drive motor (not shown) terminates in a connector 150. The connector 150 connects to a wiring harness joined to the game controller 240. The dispenser trays 136 and hanging prize dispensers 142 are set back sufficiently from the clear panel 28 of the door 58 to allow dispensed prizes to fall into a drop box behind the retrieval door 52.

As shown in FIGS. 7-10, a coin toss gun 160 has a chassis 162 having a launch end 228 and a loading end 230. A handle 164 extends generally perpendicularly downwardly from the chassis 162 at the loading end 230. A dual access swivel mount 36 is attached around the chassis 162. The swivel mount 36 has a turret 168 mounted within a turret support 158. The turret 168 and support 158 have complimentary spherical surfaces to allow the gun 160, when installed in the cabinet 22, to swivel in two directions, i.e., vertically and horizontally. The support 158 has flanges 168 for mounting the gun 160 to the cabinet 22, i.e., to mount the gun 160 to the gun plate 34 on the gun panel 30, as shown in FIG. 3.

Weights are attached to the launch end of the gun (i.e., the end positioned inside of the cabinet). The gun is balanced so that in the standby position, the launch end points downwardly and gravity will cause a coin inserted into the gun to slide downwardly and into the launch position.

Figure 7:
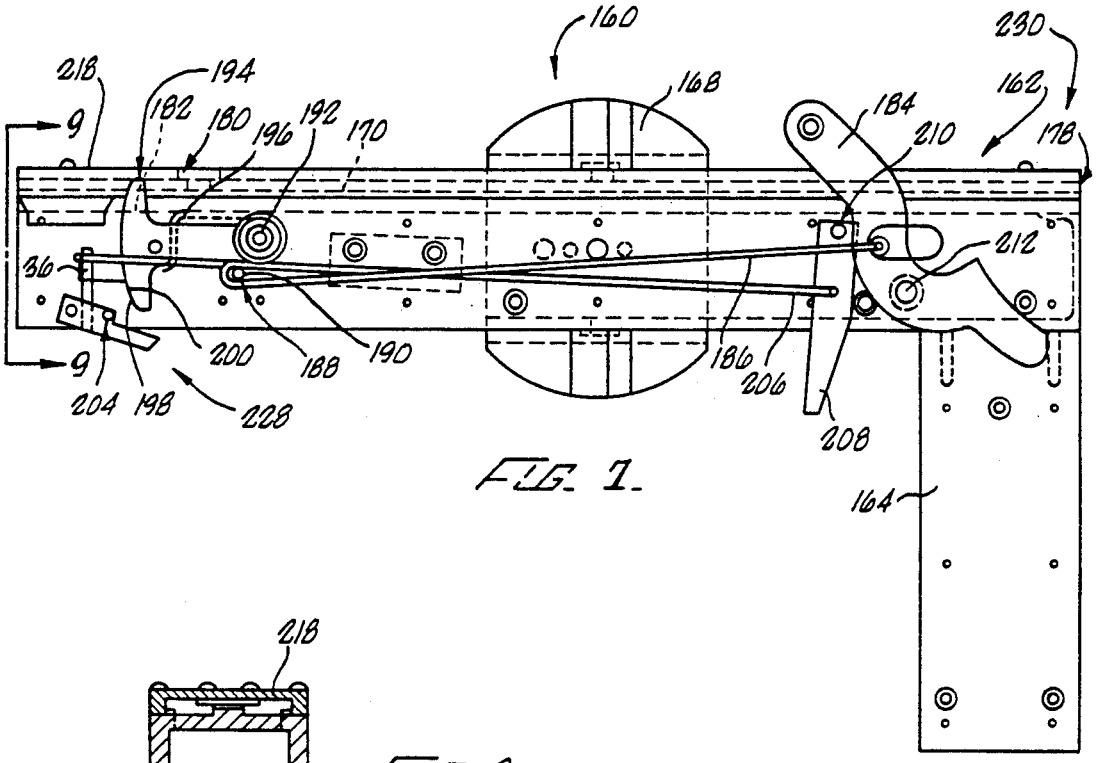
FIG. 7 is a side section view of the coin toss gun shown in FIGS. 1 and 3.
Figure 9:
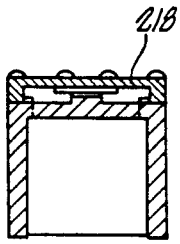
FIG. 9 is an end view thereof taken along line 9-9 of FIG. 7.
Figure 8:
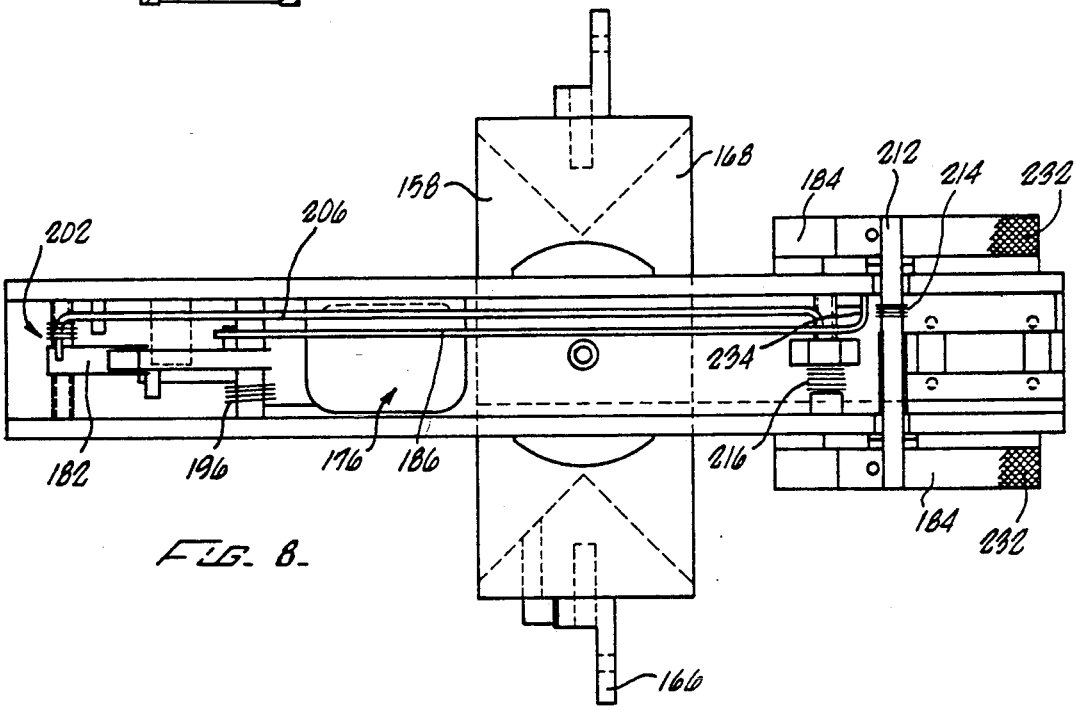
FIG. 8 is a bottom section view thereof.
Figure 10:
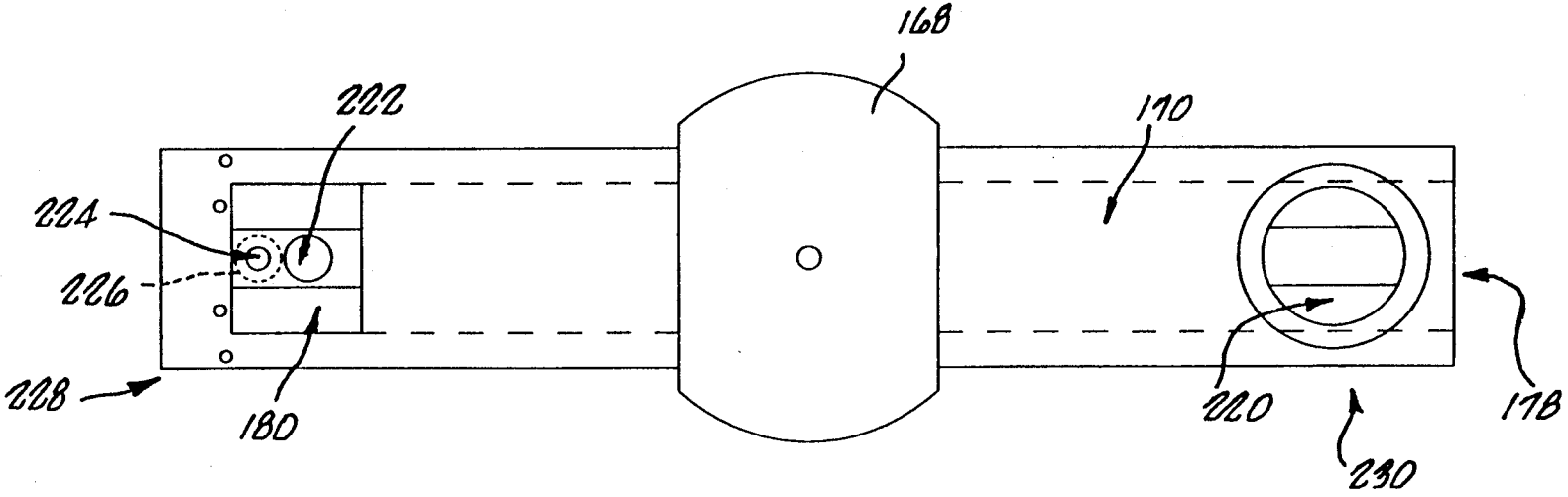
FIG. 10 is a top elevation view of the coin toss gun.

Referring to FIGS. 7 and 10, the chassis 162 has a coin track 170 extending from a top loading hole 220 at the loading end 230, to a hammer hole 222 at a launch position 180 at the launch end 228. The coin track 170 is covered by a cover plate, or can be formed by an appropriately shaped extrusion. A loading slot 178 may be provided at the back surface of the gun 160 above the handle 164, as an alternate coin loading position instead of the top loading hole 220. As shown in FIG. 8, a discharge slot 176 is provided through the chassis 162 beneath a section of the coin track 170, to allow debris or improperly sized coins to fall out of the gun 160. To avoid awarding points for slugs, foreign coins, etc., a coin counting and measuring device, at the end play, verifies that a proper coin has been shot before any points are awarded. The gun is designed to operate with different types of coins or tokens. A coin detector, preferably an electronic sensor detects the presence of a coin and begins game play.

As shown in FIGS. 7 and 8, a hammer 182 is pivotally mounted on a hammer pivot shaft 192. The hammer has a hammer face 194, a claw 172 and an eccentric boss 190. A hammer spring 196 engages the hammer 182 and a pin or protrusion in the chassis 162. The hammer spring 196 biases the hammer 182 in an upward or clockwise (as shown in FIG. 7) direction.

A rachet pawl 198 is pivotally mounted on a rachet pivot pin 204. A rachet spring 202 engages the rachet pawl 198 and a pin or protrusion in the chassis 162, and biases the rachet pawl 198 against the claw 172 of the hammer 182. The claw 172 has a rachet surface 200, to securely engage the rachet pawl 198.

Towards the loading end 230 of the gun 160 are pull back lever arms 184, pivotally mounted on either side of the chassis 162 on a lever arm pivot shaft 212. A return spring 214 biases the lever arm pivot shaft 212 counterclockwise (as shown in FIG. 7) urging thumb or finger surfaces 232 on the pull back lever arms 184 upwardly. A pull back rod 186 is pivotally attached to an armature 234 extending from the lever arm pivot shaft 212, at the loading end 230, to a rod end 188 on the boss 190 of the hammer 182, at the launch end 228 of the chassis 162.

A trigger 208 is pivotally mounted on a trigger pivot pin 210 in the chassis 162. A trigger rod 206 is pivotally attached to the trigger 208 and extends through the chassis 162 to an eccentric extension 236 on the rachet pawl 198. In an alternative gun design, the gun has a spring linked to a rod connecting the lever arm and the hammer. With this design, the lever arm is simply drawn back for appropriate tensioning and then immediately released.

A coin stop 218 is provided on the chassis 162 at the launch end 228 to appropriately position a coin over the hammer hole 228. A detector hole 224 is positioned adjacent to the hammer hole 222, with a coin detector 226 below or within the detector hole 224.

Figure 11:
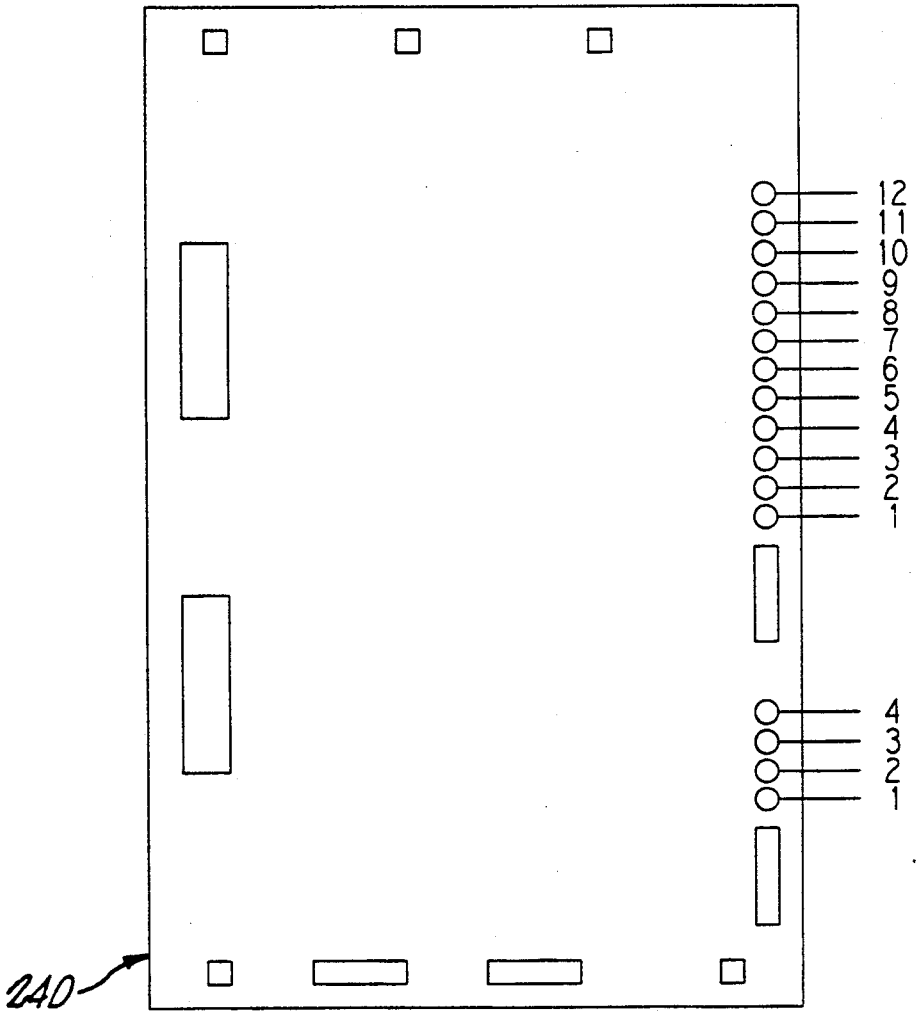
FIG. 11 is a schematic illustration of the electronic game controller.
Figure 12:
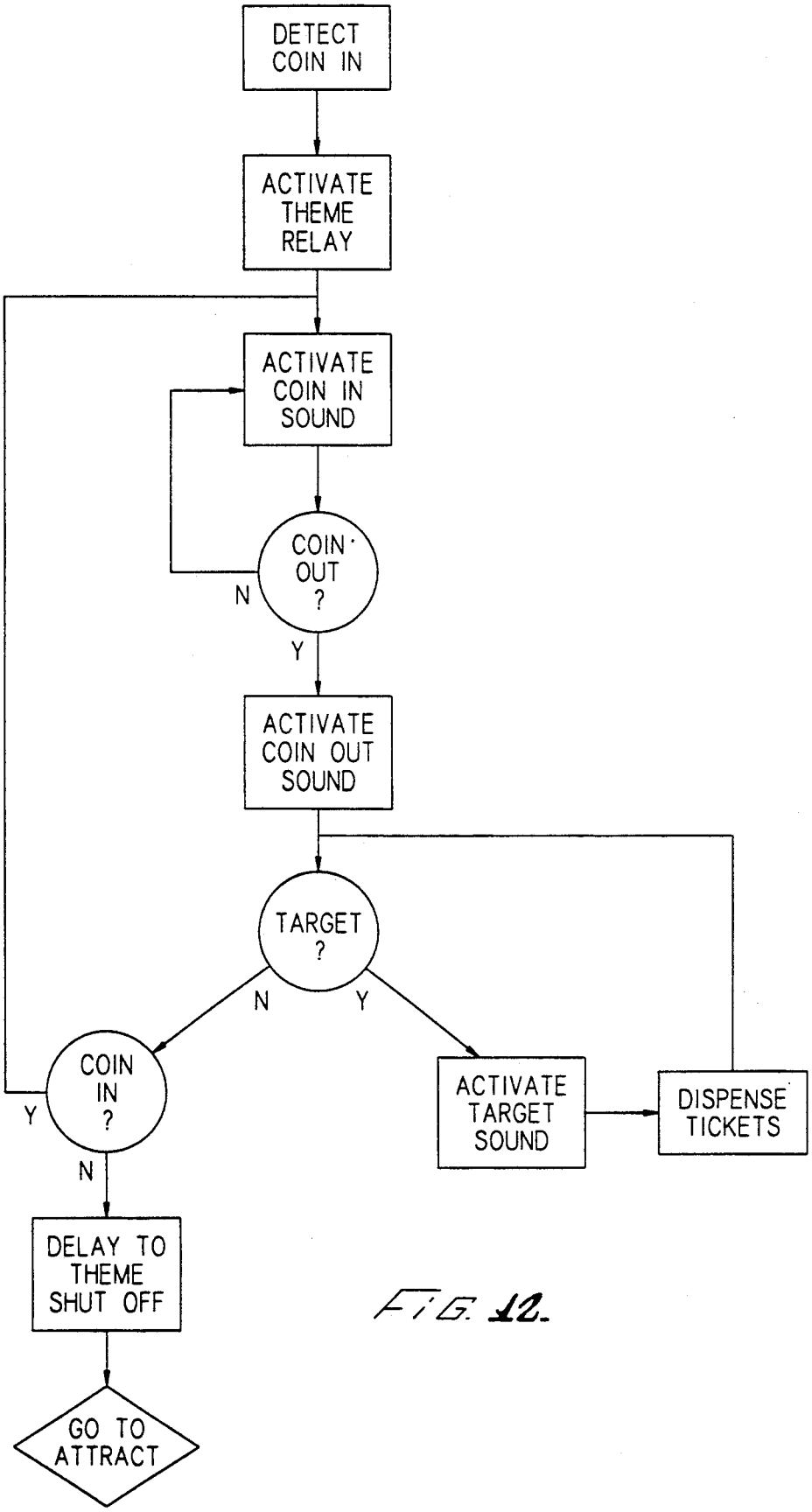
FIG. 12 is a flow chart illustrating a mode of operation effected by the game controller.
Figure 13:
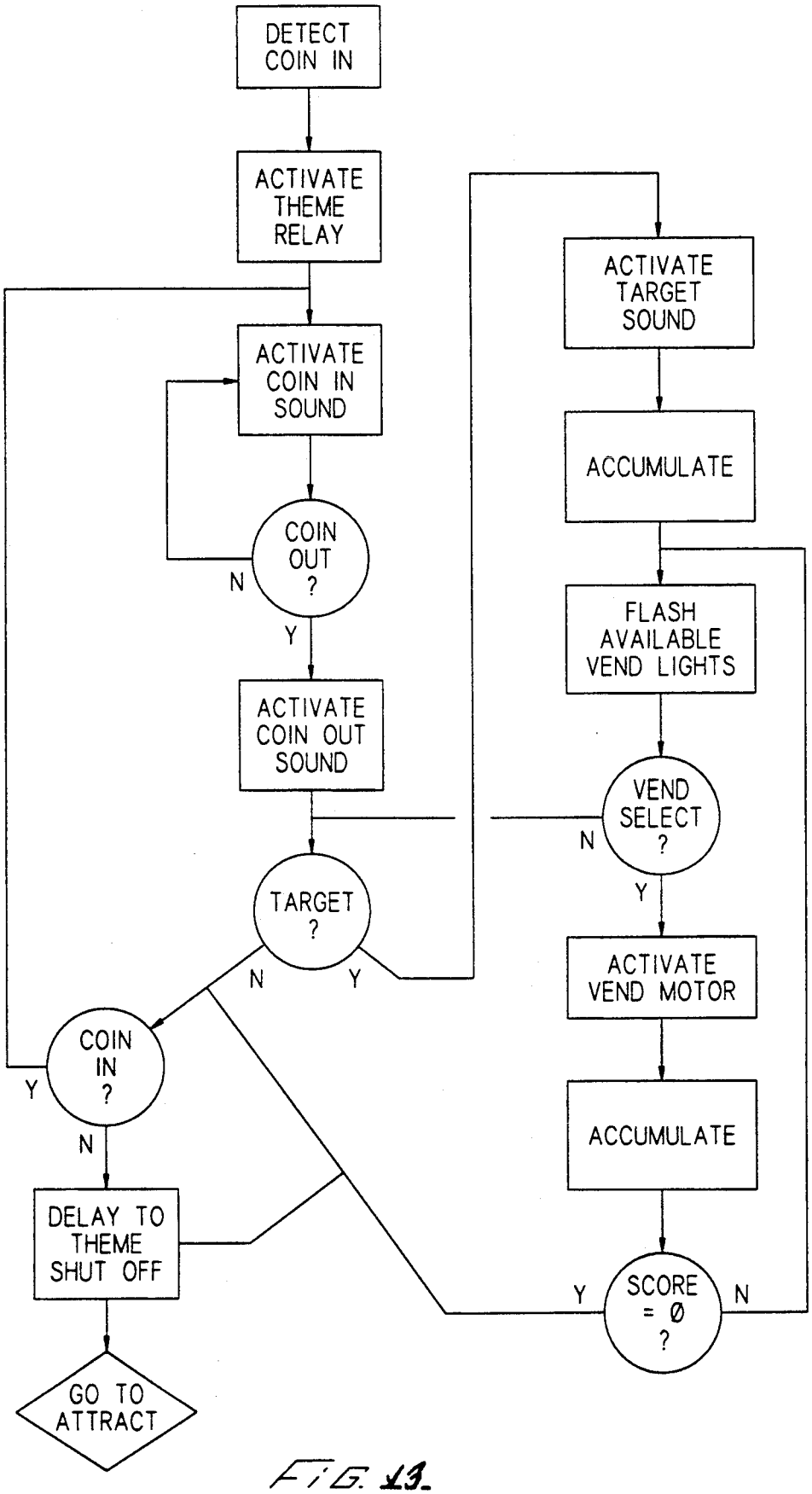
FIG. 13 is a flow chart illustrating a second mode of operation effected by the game controller.
Figure 14:
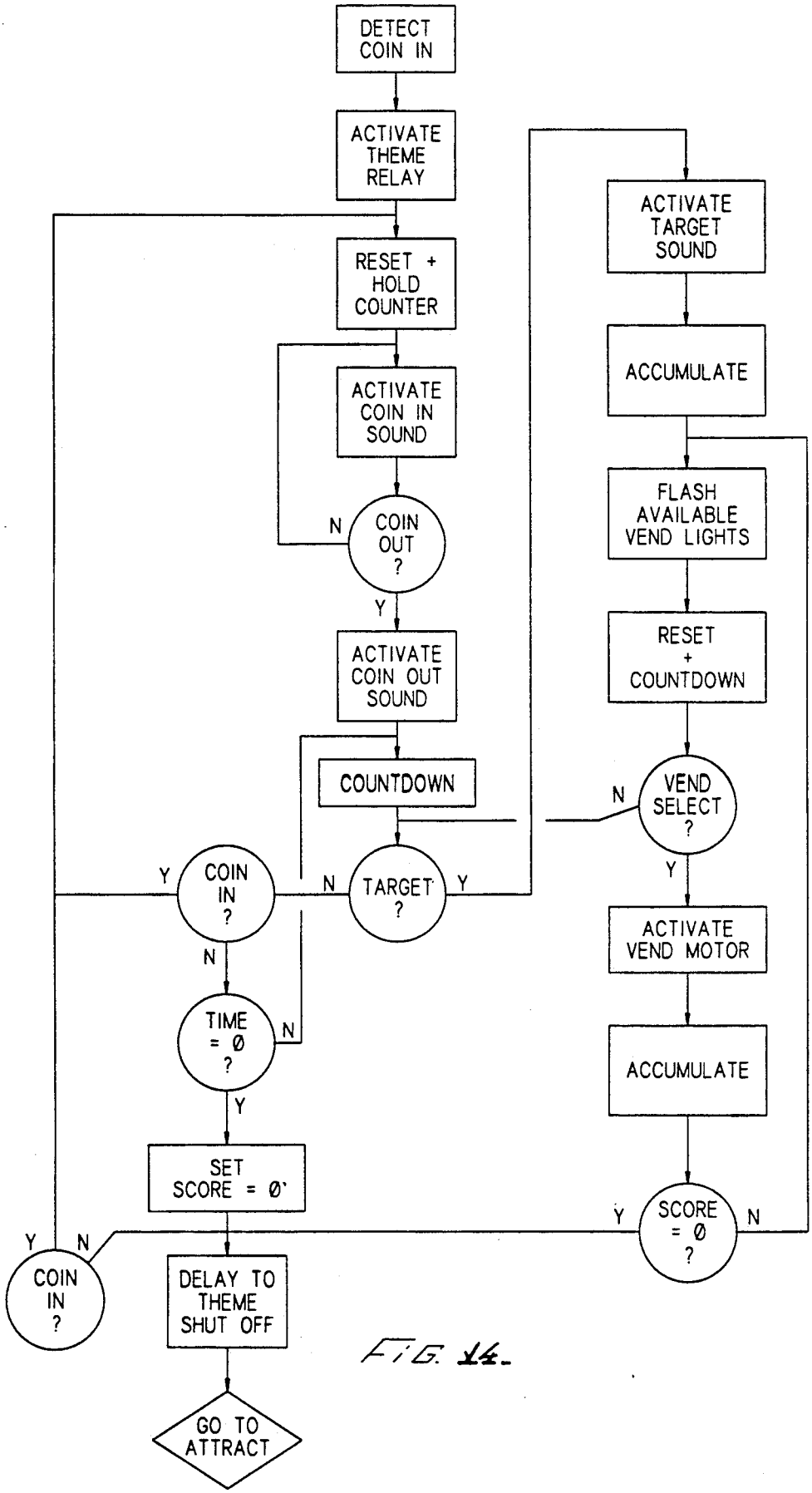
FIG. 14 is a flow chart illustrating a third mode of operation effected by the game controller.

The bulk select buttons 42, key pad 48, coin detector 86, display 126, prize lights 144 and coin detector 226, as well as lights and other components, are wired to a game controller 240 (FIG. 11) within the cabinet 22. The game controller includes counters, logic and switching components for operation of the game unit 20.

Figure 19:
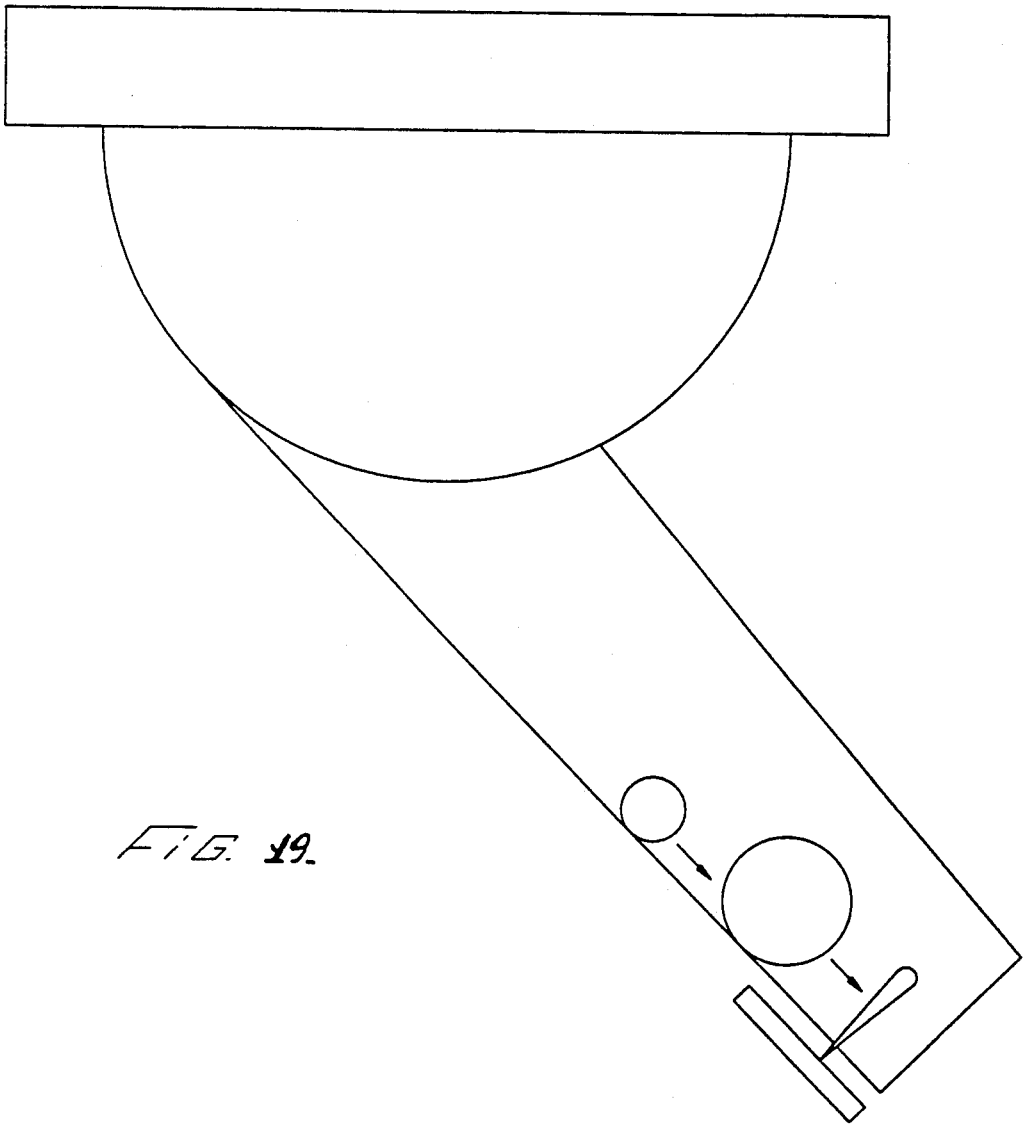
FIG. 19 is a side view in part section of an adjustable coin sensor.

As shown in FIG. 19, the height of a sensor can be adjusted so that a quarter (large diameter) will be detected, but a nickel (small diameter) will not. This adjustment can also be made to differentiate between nickels and pennies, etc.

Figure 20:
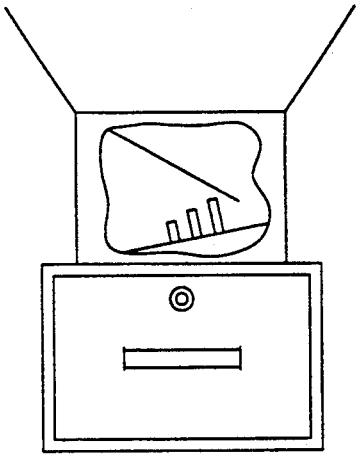
FIGS. 20 and 21 are schematic illustrations of a coin box sensor.
Figure 21:
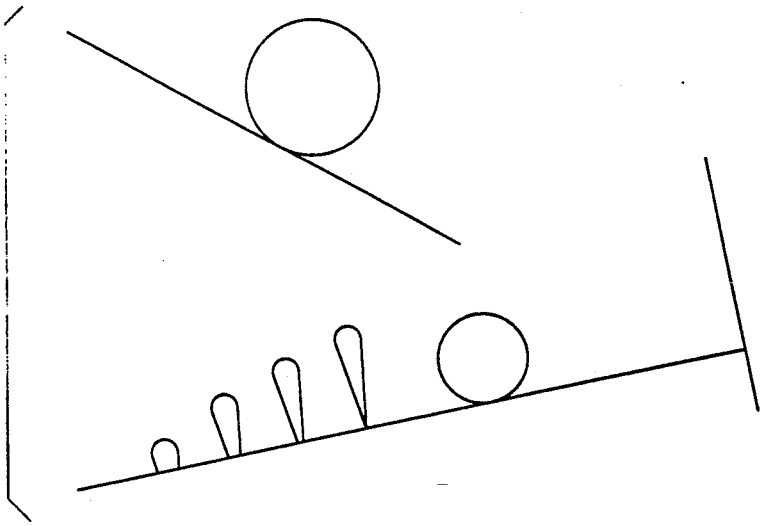

Referring to FIG. 20, four sensors of different heights allow a coin to pass into the cash box while detecting the size (and thus value) of the coin. The tallest sensor detects quarters only. The next tallest detects quarters and nickels. The third tallest detects quarters, nickels and pennies. The smallest detects quarters, nickels, pennies, and dimes. The game uses these sensor signals to determine what type of coin has been played.

In operation, the game operator (i.e., the owner or maintainer of the game unit) sets various game parameters (e.g., points scored for various events) by programming the game controller 240 and adjusting the position and/or orientation of the bowels. The gun tensioning range and turret swivel range can be adjusted by the game operator. The operator loads bulk prizes into the bulk dispensing unit 40 and prizes 140 onto the dispenser trays 136 and hanging prize dispensers 142. The game unit 20 can advantageously be located in convenience stores, video stores, and in other locations where space is limited and a redemption center is not practical or possible. The game unit 20 occupies only approximately 20 square feet of floor space. Since the prize dispenser 62 effectively replaces and surpasses the functions of a redemption center, the game unit 20 can be successfully operated in lower volume and lower traffic locations. The game controller 240 controls all functions of the game unit 20, such that an attendant is no longer required to exchange tickets or tokens for prizes.

The game controller 240 initially places the game unit 20 into an attract mode. The attract mode may include switching cabinet lighting on and off, sequencing the marquee lights 54 and optionally includes audio components, to attract players.

A player places a coin 120 into the loading slot 178 or a top loading hole 220 of the coin toss gun 160. The gun 160 is then tilted or swiveled so that the coin slides down the coin track 170 of the chassis 162 of the gun 160. The coin comes to rest against the coin stop 218 at the launch end 228 of the gun 160. The coin is then resting in the coin track 170 over the hammer hole 222. The coin detector 226 detects the presence of the coin and the game controller 240 further prepares the skill game 60 for operation by e.g., causing the wiper 114 to turn, generating sound effects, illuminating messages for the player on the display 126, illuminating "theme lights", etc.

The player presses on the finger surface 232 of the pull back lever arms 184, to set the tension or tossing force of the player's shot. While holding the handle 164, the player aims or positions the gun. An add on scale or pointer can be provided so the player can measure the tension applied in pushing on the lever arms. The handle 164 and loading end 230 of the gun 160 are mounted on the outside of the cabinet 22, while the launch end 228 and hammer hole 222 are inside of the cabinet 22. The dual access swivel joint 36 allows the player to position the launch end 228, in two dimensions, by manipulating or positioning the handle 164.

As the pull back lever arms 184 are pressed down by the player, the pull back rod 186 pulls on the boss 190 causing the hammer 182 to pivot downwardly (or counterclockwise in FIG. 7). The further the pull back lever arms 184 are pressed down by the player, the further the hammer 182 will be drawn back against the biasing force of the hammer spring 196. The rachet pawl 198 continuously engages the rachet surface 200 to prevent the hammer 182 from prematurely releasing. With the gun 160 properly aimed, the player squeezes the trigger 208. The trigger 208 pulls back on the trigger rod 206 causing the rachet pawl 198 to rotate and release the rachet surface 200 of the hammer 182. The hammer 182 rapidly swings or pivots upwardly (clockwise in FIG. 7), driven by the force of the hammer spring 196. The hammer face 194 passes through the hammer hole 222 and strikes the coin. The coin is tossed or shot up and out perpendicularly to the gun chassis 162.

The return spring 214 returns the pull back lever arms 184 to the rest position to avoid snap back when the hammer is triggered. The rachet spring 202 returns the rachet pawl 198 to its rest position. Similarly, the trigger spring 216 returns the trigger 208 to its original position, such that the gun 160 is reset for another coin toss.

The hammer face 194 is positioned relative to the hammer hole 222 so that it strikes the coin in an off-center position, causing the coin to fly up from the gun 160 with a flipping motion, i.e., the coin flies in a trajectory while rotating end over end. The dual access swivel mount 36 allows the player to adjust the tossing direction towards any position within the cabinet 22. The pull back lever arms 184 and hammer-rachet pawl mechanism allows the coin to be tossed using various tensions, to adjust the height or speed of the toss. The player can then reach various heights and depths inside the cabinet 22.

A skilled player who has properly aimed and tensioned the gun 160 to achieve maximum points can shoot the coin into the first bowel 70. The coin will then enter and slide through the chute 84 of the first bowel 70. The coin detector 86 in the first bowel 70 will detect coin and the game controller 240 will count and/or record the number of points awarded for the first bowel 70. The game controller 240 will also generate sound effects as points are scored. The coin will then automatically similarly pass through the second bowel 72, third bowel 74 and fourth bowel 76, with additional points recorded for each of these bowels.

The coin then passes out of the chute 84 of the fourth bowel 76 and drops onto a specific predetermined drop location in the pad 118 of the wheel unit 100. The slowly turning or alternating wiper 114 moves around and contacts and pushes the coin 120 in a geometric path 112 leading to a target hole 106 in the wheel unit 100 as shown in FIGS. 4 and 5. As the wiper pushes the coin, the coin will consistently roll on the pad 118 in the geometric path from the drop location to the target hole. Of course, if a coin lands on the pad away from a drop location, the coin will be pushed off by the wiper in between target holes and will fall off the wheel unit 100 without scoring additional points. The chute 84 on the fourth bowel 76 is positioned sufficiently close to the pad 118 to be able to consistently drop or place the coin onto a drop location.

Figure 17:
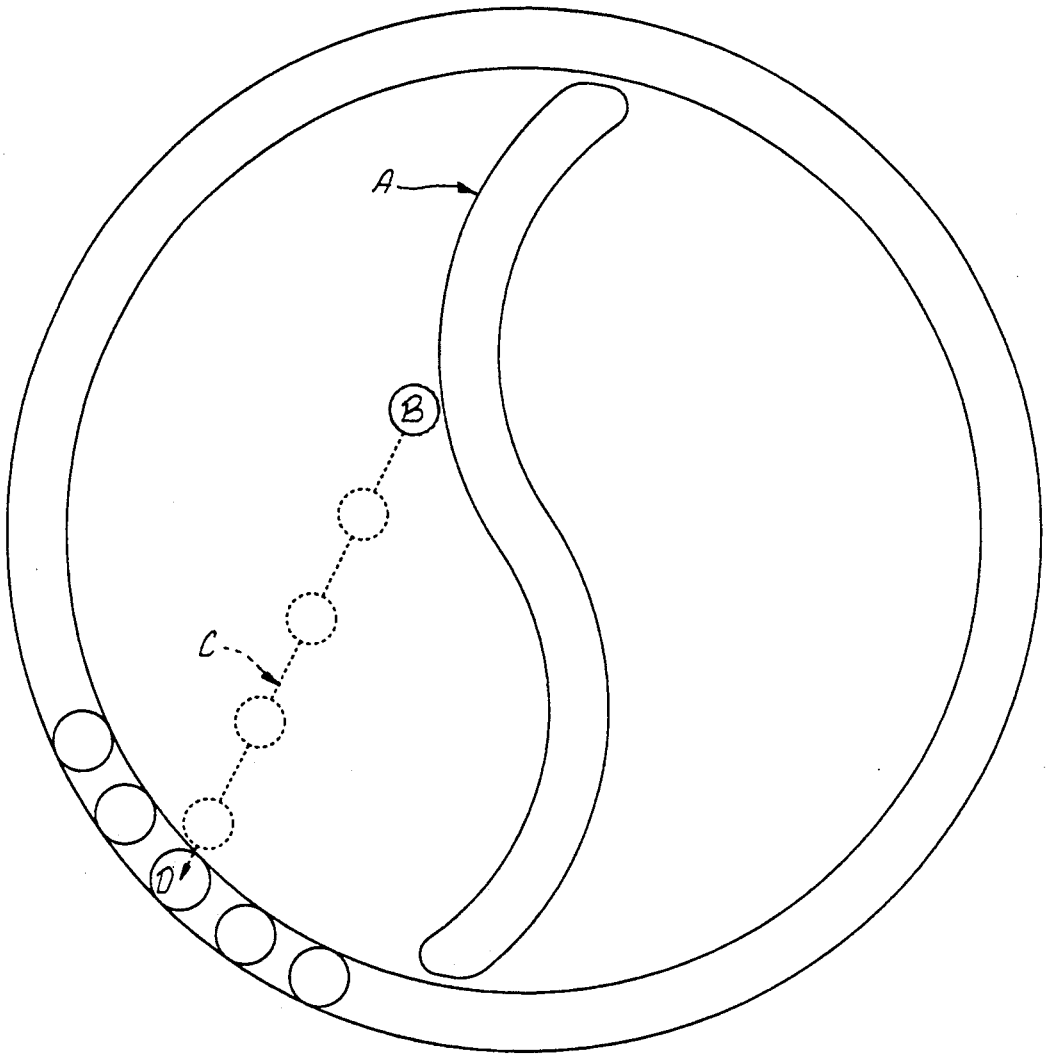
FIGS. 17 and 18 are top views illustrating the operation of the wheel unit of FIG. 4.

Referring to FIG. 17, the leading edge 'A' of the wiper 114 has a curvature that causes coin 'B' to move rapidly toward the outside edge of table 112. The coin rolls along leading edge 'A' while proceeding in a linear path 'C' toward a target hole 'D'. Given the starting point marked by coin 'B', path 'C' is precise and repeatable. Significantly, if leading edge 'A' was not curved, but instead was straight (the wiper then resembling a straight diameter) the coin motion would differ. Instead of following linear path 'C', the coin would follow a long, outwardly spirally path with an unpredictable end point. By using the curved leading edge 'A' the coin's end point is predictable.

Figure 18:
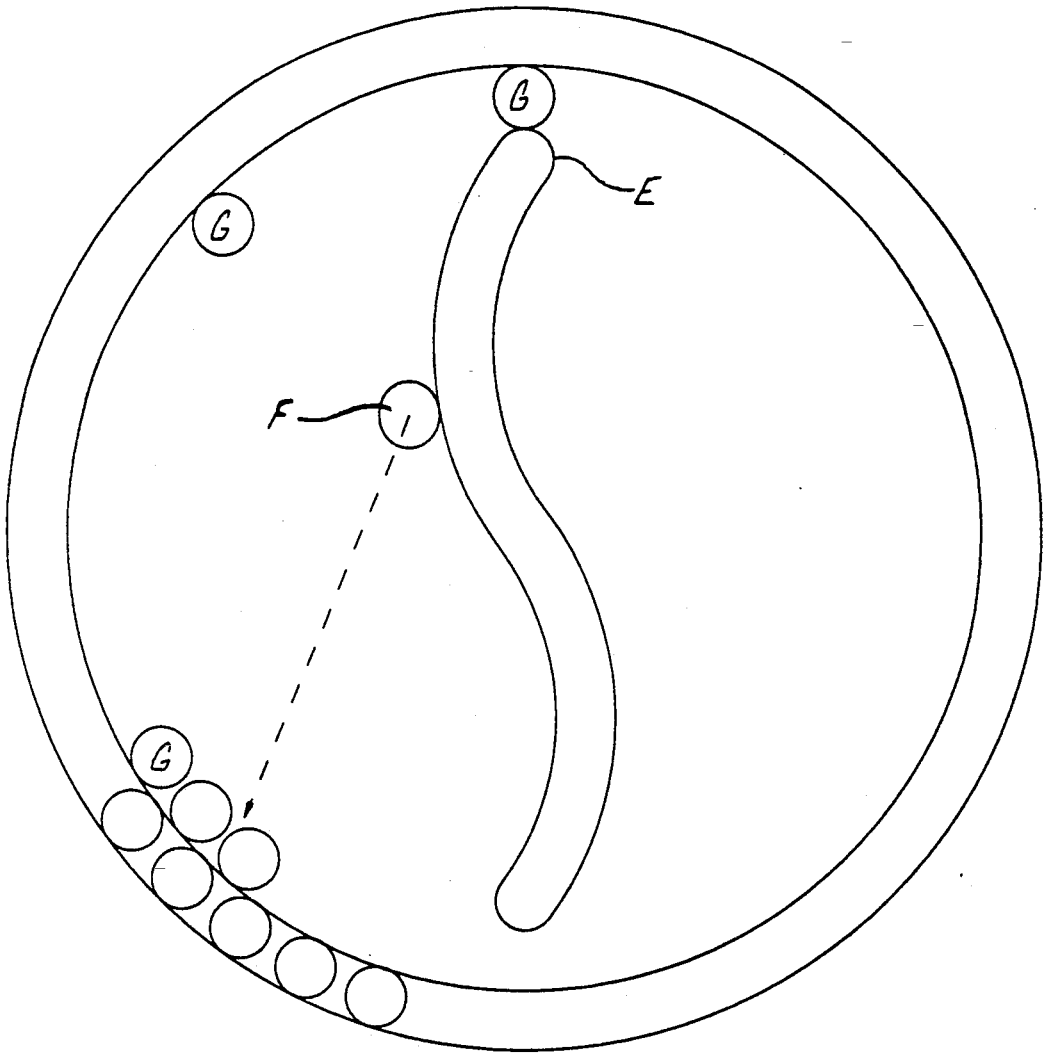

As shown in FIG. 18, the wiper can be made to have short ends 'E' that allow coins 'G' to accumulate around the rim of the table. An additional coin 'F' is then required to push coins 'G' into one or more target holes. Coins 'G' act as an incentive to attract more players to the game. An alternative disk or platter has a beveled rim around the edge to allow coins to build up around the outer edge and hang off, about to fall.

As the coin 120 is pushed from a drop location off of the pad 118 by the wiper 114, the coin falls into a target hole 106, is detected by the coin detector 86 and additional points are recorded. A hard material may be substituted for, or placed on the opposite side of the felt pad 118 which can be flipped over. However, such a hard material will cause the coin 120 to bounce and fall off of the table surface 112 or land off of a drop location, in a position on the table surface not lying on a geometric path 22 leading to a target hole 106. Similarly, coin tosses which miss any of the bowels and land on the table surface 112, may or may not be swept by the wiper 114 into a target hole 106 for additional points, depending on whether the coin 120 comes to rest at any of the drop locations on a geometric path 122 leading to a target hole. Coins which miss any of the bowels or wheel unit 100, because of improper aiming or tensioning of the gun 160, fall through the grate 128 and are collected in the coin box 132. Coins passing through the target holes 106 similarly fall through the base 102 of the wheel unit 100 into the coin box 132. A grate coin detector can be provided to detect coins passing only through the gate, so that a consolation prize or points can be awarded.

The prizes in the prize dispenser 62 are in front of the player while the skill game 60 is being played. Accordingly, the player can play with the intent of winning specific prizes, and not simply for entertainment, with tickets or tokens only incidentally dispensed by the machine as previously known. Having the prizes before the player, at all times, attracts and motivates the player to play the skill game 60 for a specific prize in the prize dispenser 62.

The bulk unit stores large amounts of lower value prizes. This allows prizes to be awarded for minimum scores without requiring constant reloading of prizes.

As the player accumulates points, the game controller 240 switches the prize lights 144 on, when the number of points required to receive the prize associated with a specific prize light 144 is reached by the player. The prize lights enable children and/or visually impaired persons to see which prizes are available to them. During or after the game, the player may redeem points for prizes using the key pad 48. By punching into the key pad the number or letter combination associated with a specific prize on the dispensers trays 136 or hanging the prize dispensers 142, the prize desired by the player is dispensed and falls to the drop box 50 where it can be retrieved through the retrieval door 52.

Specifically, the game controller 240 interprets the switch combination from the key pad 48 and actuates or switches on the spiral pusher motor for the dispenser tray 136 or hanging prize dispenser 142 associated with the letter or number combination received from the key pad 48. The game controller 240 also debits or subtracts from the player's accumulated points the number of points redeemed for the prize received. Accordingly, during or after the game, a player having earned a certain number of points may elect to receive a single prize having a high point value, or several prizes of lower point values.

The game controller has the capability to record data on the number of coins played and the number and value of prizes dispensed, to calculate a "points per coin" average. This average can be used by the operator to determine how much buying power the average player has per coin. The operator can then adjust the point value of each prize to prevent a prize from being too difficult or too easy to win.

Although the drawings show a game unit 20 having a single cabinet 22 holding the skill game 60 and prize dispenser 62, in an alternate embodiment, the skill game 60 and prize dispenser 62 may be contained in separate cabinets which may be attached together in a modular system. In addition, various numbers of bowels or other targets may be provided within the game unit in varying arrangements. Bowels or targets may also be attached to the wiper shaft 116 or otherwise made to revolve or move about within the cabinet 22 in a pattern or timed sequence. In this embodiment, the player must time his shots to account for movement of the targets. Similarly, in an embodiment having motor driven continuously revolving bowels, the player must time his shots to coincide with a desired orientation of the chute of the turning bowel.

Thus, a novel game unit is disclosed and described. While embodiments and applications of this invention have been disclosed and illustrated, it would be apparent to those skilled in the art that many more modifications are possible without departing from the inventive concepts herein. The invention, therefore, is not to be restricted except in the spirit of the appended claims.

What is claimed is:

1. A coin game unit comprising:

a cabinet having a transparent enclosure section;

a coin game within the cabinet;

a prize dispenser within the cabinet for holding and dispensing prizes, the game and prize dispenser viewable at least in part through the transparent enclosure section;

a counter linked to the game for counting game points; and a dispenser controller linked to the counter and the dispenser, for actuating the dispenser based on the counted game points.

2. The game unit of claim 1 further comprising a partition substantially separating the game from the dispenser, within the cabinet.

3. The game unit of claim 1 further comprising a prize light associated with the dispenser and linked to the counter.

4. A coin game comprising:

a coin game cabinet;

a grate support within the game cabinet;

a round target hole base on the grate support, the base having a generally flat top surface and a target hole surface extending at an angle from top surface toward the grate support, the target hole surface having a plurality of spaced apart target holes;

a cover on the top surface of the base;

a wiper for rotatably wiping over substantially the entire cover; and means for rotating one of the base and the wiper.

5. The skill game of claim 4 wherein the base is fixed within the cabinet, and further comprising means for rotating the wiper.

6. The skill game of claim 4 wherein the cover comprises a felt pad.

7. The skill game of claim 4 wherein the target holes are equally spaced apart.

8. The skill game of claim 4 further comprising an outer post associated with substantially each target hole.

9. The skill game of claim 4 further comprising a coin detector associated with substantially each target hole.

10. The skill game of claim 4 further comprising a bowel chute supported above the base.

11. The skill game of claim 9 further comprising a score display linked to the coin detector.

12. A skill game comprising:

a cabinet;

a first bowel supported in the cabinet, and having a coin chute;

a first coin detector linked to the first bowel for detecting passage of a coin through the chute of the first bowel;

means for moving the first bowel in a timed sequence;

a second bowel supported in the cabinet below the first bowel, and having a coin chute; and a second coin detector linked to the second bowel for detecting passage of a coin through the chute of the second bowel.

13. The skill game of claim 12 further comprising a score display within the cabinet linked to the first and second coin detectors.

* * * * *